United States Patent [19]

Kursar

[11] Patent Number: 4,694,732

[45] Date of Patent: Sep. 22, 1987

[54] CLEARANCE POCKET ASSEMBLY

[75] Inventor: James V. Kursar, Horseheads, N.Y.

[73] Assignee: Ingersoll-Rand Company, Woodcliff Lake, N.J.

[21] Appl. No.: 846,065

[22] Filed: Mar. 31, 1986

[51] Int. Cl.[4] ..... F01B 31/14

[52] U.S. Cl. ..... 92/60.5

[58] Field of Search ..... 92/60.5, 121, 122; 220/20, 22; 417/274

[56] References Cited

U.S. PATENT DOCUMENTS

| | | | |
|---|---|---|---|
| 1,997,476 | 4/1935 | Wallene | 92/60.5 X |
| 2,423,677 | 7/1947 | Balogh | 92/60.5 X |
| 2,596,004 | 5/1952 | Barrett | 92/60.5 X |
| 3,174,677 | 3/1965 | Ramstad | 92/60.5 |
| 3,181,513 | 5/1965 | Young | 92/121 X |
| 3,198,421 | 8/1965 | Alyea et al. | 92/60.5 |
| 3,354,785 | 11/1967 | Sagawa | 92/121 X |
| 3,354,790 | 11/1967 | Race | 92/60.5 X |
| 3,878,770 | 4/1975 | Ashton | 92/60.5 |
| 4,532,685 | 8/1985 | Itoh et al. | 92/60.5 X |

FOREIGN PATENT DOCUMENTS

| | | | |
|---|---|---|---|
| 365476 | 12/1962 | Switzerland | 92/60.5 |
| 1371436 | 10/1974 | United Kingdom | 92/60.5 |

*Primary Examiner*—Robert E. Garrett
*Assistant Examiner*—Mark A. Williamson
*Attorney, Agent, or Firm*—Bernard J. Murphy

[57] ABSTRACT

In a first embodiment, the assembly includes a shallow, substantially figure eight-shaped chamber of intersecting bores with a pair of rotors journalled therein. The chamber has upper and lower, parallel walls which are joined together by means of a peripheral, chamber-enclosing wall. The lower wall has an aperture therein for opening onto a cylinder of an air compressor, or the like, and the rotors sealingly interface the parallel and peripheral walls. By rotating the rotors toward or away from the aperture, a substantial volume of the chamber is closed off from, or opened to, the aperture. Thus, by mounting the Assembly onto a cylinder, with the aperture opening thereinto, the Assembly can be used to alter the effective volume of the cylinder without significantly adding dimension to the cylinder length or diameter.

8 Claims, 6 Drawing Figures

CLEARANCE POCKET ASSEMBLY

This invention pertains to clearance bottles, and clearance pocket assemblies, and the like, such as are used to alter the effective volumes of air compressor cylinders, and in particular to a novel clearance pocket assembly of simple construction which does not add, significantly, to the effective overall length or diameter of the cylinders.

Clearance bottles, such as is incorporated in the "Compressor Mechanism" of H. A. Gehres, as disclosed in U.S. Pat. No. 1,969,507, of Aug. 7, 1934, are well known. For their purposes, they are efficient and uncomplicated. However, they are not variable, as to the clearance volume they offer. Too, they are obtrusive and obstructive.

Variable, in fact, stepless control of a cylinder volume is provided in prior art devices, i.e., clearance pocket assemblies, and the U.S. Pat. No. 4,068,562, issued to M. I. Frenkel, for a "Cylinder of Piston Compressor", on Jan. 17, 1978, is probably exemplary thereof. Here, however, the device is disposed laterally, relative to the associated cylinder, and requires considerable length, as the volume-controlling piston must move therealong, lengthwise thereof.

Another U.S. Pat. No. 3,878,770, issued to Robert Ashton, on Apr. 22, 1975, for a "Clearance Pocket Assembly", and assigned to the same assignee as in this present application, requires no axially translating piston. Rather, the Ashton device calls for rotatable valving elements to open or close a clearance volume to a cylinder. However, the clearance volume is fixed by removable spacers; too, it entails no little disassembly and re-assembly to change spacers (to vary the clearance volume).

What the art has long needed is a clearance pocket assembly of simple construction and operation, offering stepless control without disassembly, and which is mountable to a cylinder without significantly increasing either the effective length or diameter of the cylinder. It is, therefore, an object of this invention to set forth just such a long-sought, clearance pocket assembly.

Particularly, it is an object of this invention to disclose a clearance pocket assembly, for altering the effective volume of the cylinder of an air compressor or the like, comprising first means defining a shallow chamber having (a) a peripheral wall, and (b) a pair of parallel walls normal to, and joined by, said peripheral wall; wherein one of said parallel walls has an aperture formed therein; and further including second means within said chamber and movable, therewithin, between a first disposition for sealing off, from fluid communication with said aperture, at least a substantial portion of said chamber, and a second disposition for opening a substantial portion of said chamber to said aperture for fluid communication therewith; wherein said second means comprises a rotor, journalled in said chamber, and having surfaces which form a constant, fluid-sealing interface with (a) said peripheral wall, and (b) both said parallel walls.

Further objects of this invention, as well as the novel features thereof, will become more apparent by reference to the following description taken in conjunction with the accompanying figures, in which.

Figure 3:
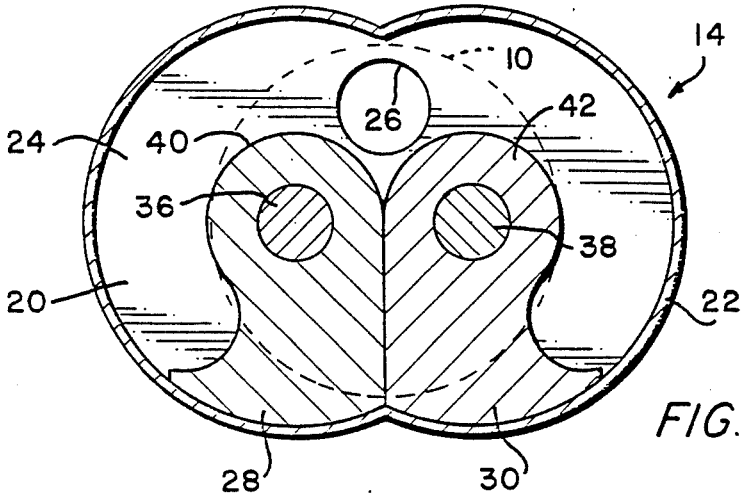
FIG. 3 is a view corresponding to FIG. 2, in which, however, the rotors are in their fully "open" disposition.
Figure 2:
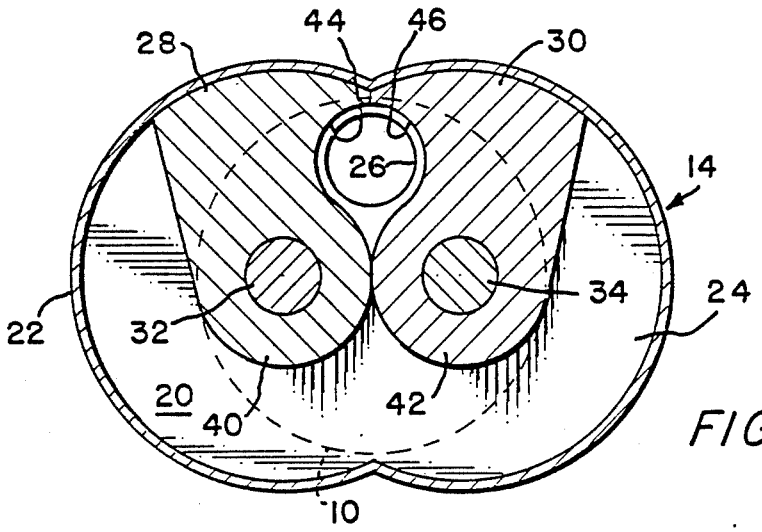
FIG. 2 is a cross-sectional view, taken along section 2—2 of FIG. 1, showing the rotors in their "closed" disposition.
Figure 1:
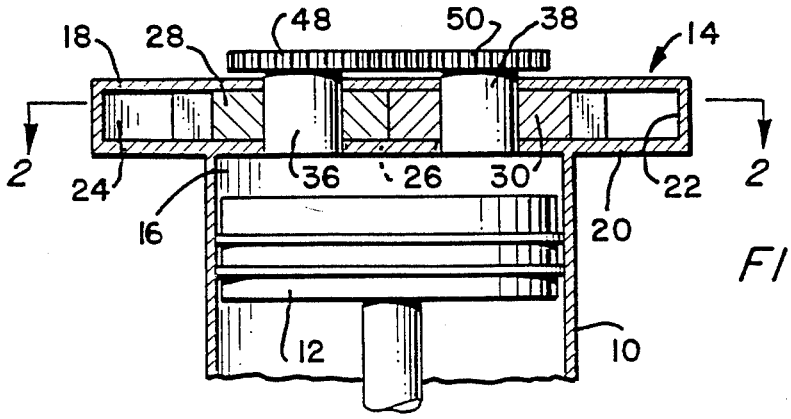
FIG. 1 is a side elevational view, partly in cross-section, of a portion of a cylinder-and-piston substructure, as in an air compressor or the like, to which has been coupled a first embodiment of the invention.

As shown in FIGS. 1–3, a cylinder 10 of an air compressor has a piston 12 reciprocably disposed therein. A first embodiment 14 of the novel clearance pocket assembly is secured to the open top 16 of the cylinder 10 (by means not shown). Embodiment 14 comprises a pair of parallel walls 18 and 20 which are joined together via a peripheral wall 22 to define a shallow chamber 24.

Wall 20 has an aperture 26 formed therein which opens onto the open top 16 of the cylinder 10. A pair of rotors 28 and 30 are journalled in the chamber 24 on parallel axes 32 and 34 by means of rotary shafts 36 and 38 fixed in rotor hubs 40 and 42. The rotors 28 and 30 each have substantially semi-circular recesses 44 and 46 formed therein which, when disposed as shown in FIG. 2, come together, confrontingly, to rest in circumjacency to the aperture 26. In this disposition of the rotors 28 and 30, only the minimal portion of chamber 24 which subsists between the recesses 44 and 46 is open to the aperture 26 (and the cylinder 10 therebelow, as shown in FIG. 1). This is so in that the radially outermost surfaces of the rotors 28 and 30 define a constant fluid-sealing interface with the peripheral wall 22, and the upper and lower surfaces of the rotors also define such sealing interfaces with the upper and lower, parallel walls 18 and 20. Further, the hubs 40 and 42 effect a rolling and fluid-sealing engagement with each other, and maintain this relationship all the while the rotors are rotated in the chamber 24.

The shafts 36 and 38 penetrate the upper wall 18 where, in this embodiment, they mount meshing gears 48 and 50. Means (not shown) drive one of the gears 48 and 50 to cause the rotors 28 and 30 to rotate from the FIG. 2 disposition thereof toward the FIG. 3 disposition. The latter illustrates the attitude of the rotors in a fully "open" disposition in which the substantial portion of the chamber 24 is in open, fluid communication with the aperture 26.

Only crescent-shaped portions of the embodiment 14 extend beyond the outside diameter of the cylinder 10, and relatively little length has been added thereby. In this practice of using rotors, in lieu of translating pistons, a stepless, simple and efficient clearance pocket assembly is provided which is unobstructive and unobtrusive.

Figure 4:
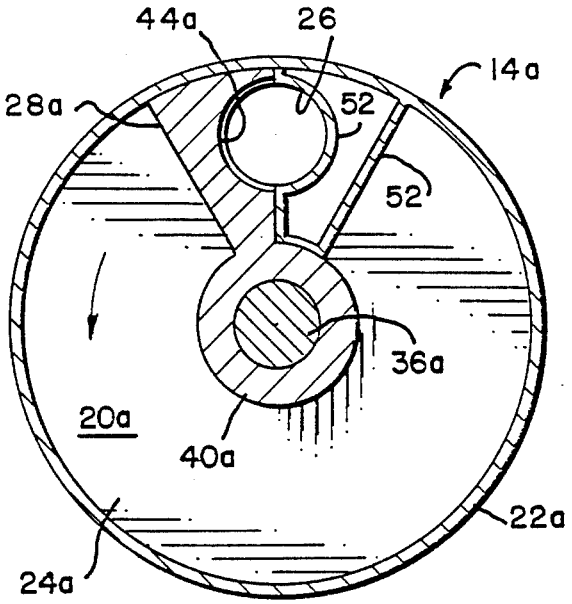
FIG. 4 is a view, similar to that of FIG. 2, of an alternative embodiment of the invention.

FIG. 4 discloses an alternative embodiment **14*a*** in which a single rotor is employed with a fully circular chamber. Index numbers which are the same as, or similar to, those in FIGS. 1–3 denote same or similar components.

The peripheral wall **22*a* is fully circular and the rotor 28*a* is journalled in the radial center of the chamber 24*a*. A further, radially-disposed wall unit 52 is sealingly coupled to the peripheral wall 22*a*, as well as to wall 20*a* (and 18*a*, not shown), and defines a fluid-sealing interface with the rotor hub 40***a*. With rotation of this single rotor 28*a*, in the arrowed direction, the greater volume of chamber 24*a* may be opened to the aperture 26 (and, concomitantly, to any cylinder thereunder).

Figure 6:
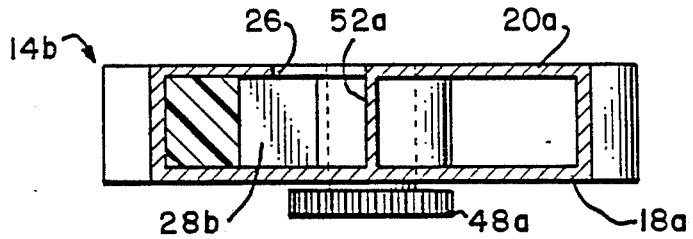
FIG. 6 is a cross-sectional view taken along section 6—6 of FIG. 5.
Figure 5:
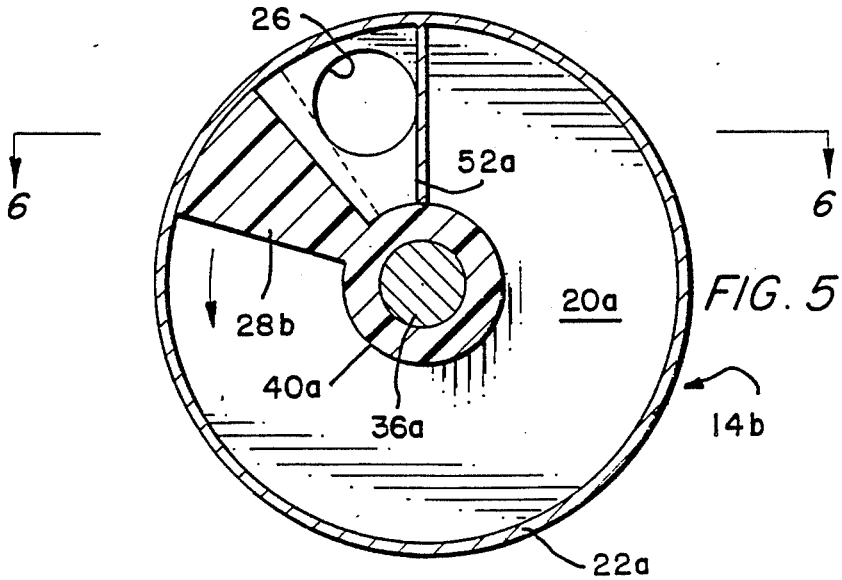
FIG. 5 is a view, like that of FIG. 2 and 4, of a further, alternative embodiment of the invention.

FIGS. 5 and 6 disclose yet a further embodiment 14*b* of the invention which, again, employs a single rotor 28*b*. Herein a single-limb wall 52*a* is radially disposed between the peripheral wall 22*a* and the hub 40*a*.

While I have described my invention in connection with specific embodiments thereof it is to be clearly understood that this is done only by way of example and not as a limitation to the scope of my invention as set forth in the objects thereof and in the appended claims.

I claim:

1. A clearance pocket assembly, for altering the effective volume of the cylinder of an air compressor or the like, comprising:

first means defining a shallow chamber having a center which is bounded by (a) a peripheral wall, and (b) a pair of parallel walls normal to, and joined by, said peripheral wall; wherein one of said parallel walls has an aperture formed therein, said aperture being offset from said chamber center; and further including second means within said chamber and movable, therewithin, between a first disposition for sealing off, from fluid communication with said aperture, at least a substantial portion of said chamber, and a second disposition for opening a substantial portion of said chamber to said aperture for fluid communication therewith; wherein said second means comprises a rotor, journalled in said chamber, and haivng surfaces which form a constant, fluid-sealing interface with (a) said peripheral wall, and (b) both said parallel walls.

2. A clearance pocket assembly, according to claim 1, wherein:

said second means comprises a pair of rotors, journalled in said chamber, and having fluid-sealing, interfacing surfaces as aforesaid; and said rotors are journalled on parallel axes.

3. A clearance pocket assembly, according to claim 2, wherein:

said rotors have circular hubs which are in rolling and fluid-sealing engagement with each other.

4. A clearance pocket assembly, according to claim 2, wherein:

said rotors have rotatable shafts which penetrate the other of said parallel walls to accommodate rotational manipulation of said rotors externally of said chamber.

5. A clearance pocket assembly, according to claim 2, wherein:

said aperture is of circular configuration; and said rotors have semi-circular recesses formed therein which, upon said rotors being in said first disposition, effect a mutually confronting relationship and, together, rest in circumjacency relative to said aperture.

6. A clearance pocket assembly, according to claim 2, wherein:

said chamber is formed of intersecting bores, having their radial centers at said axes, simulating, generally, a figure eight conformation.

7. A clearance pocket assembly, according to claim 2, wherein:

said rotors are identical.

8. A clearance pocket assembly, according to claim 1, wherein:

said chamber is fully circular and has a radial center;

said rotor has a circular hub, and is journalled on said center; and said chamber further has an inner wall having a first end termination in a constant, fluid-sealing interface with said hub, and a second, opposite, end termination fluid-sealingly coupled to said peripheral wall.

* * * * *